United States Patent [19]

Bissett et al.

[11] 4,153,427

[45] May 8, 1979

[54] APPARATUS AND METHOD FOR FEEDING COAL INTO A COAL GASIFIER

[75] Inventors: Larry A. Bissett; Gary R. Friggens; James P. McGee, all of Morgantown, W. Va.

[73] Assignee: The United States of America as represented by the United States Department of Energy, Washington, D.C.

[21] Appl. No.: 880,820

[22] Filed: Feb. 23, 1978

[51] Int. Cl.[2] ..... C10J 3/50

[52] U.S. Cl. ..... 48/86 R; 34/10; 34/57 A; 48/73; 48/99; 48/202; 48/DIG. 7; 414/291; 406/197

[58] Field of Search ..... 48/73, 86 R, 76, 77, 48/101, 197 R, 202, 206, 210, 99, DIG. 7; 201/20; 202/117; 214/17 A, 17 B, 17 C; 222/194; 159/16 R, 29, 16 S, DIG. 9, DIG. 33; 34/10, 57 A; 302/66

[56] References Cited

U.S. PATENT DOCUMENTS

| | | | |
|---|---|---|---|
| 2,595,234 | 5/1952 | Eastman | 48/DIG. 7 |
| 2,864,560 | 12/1958 | Carkeek et al. | 48/DIG. 7 |
| 2,914,391 | 11/1959 | Stratford | 48/197 R |
| 2,946,670 | 7/1960 | Whaley | 48/197 R |
| 3,715,195 | 2/1973 | Tassoney et al. | 48/197 R |
| 3,871,839 | 3/1975 | Moody | 48/197 R |

*Primary Examiner*—S. Leon Bashore
*Assistant Examiner*—George C. Yeung
*Attorney, Agent, or Firm*—Dean E. Carlson; Stephen D. Hamel; Earl L. Larcher

[57] ABSTRACT

This invention is directed to a system for feeding coal into a gasifier operating at high pressures. A coal-water slurry is pumped to the desired pressure and then the coal is "dried" prior to feeding the coal into the gasifier by contacting the slurry with superheated steam in an entrained bed dryer for vaporizing the water in the slurry.

9 Claims, 1 Drawing Figure

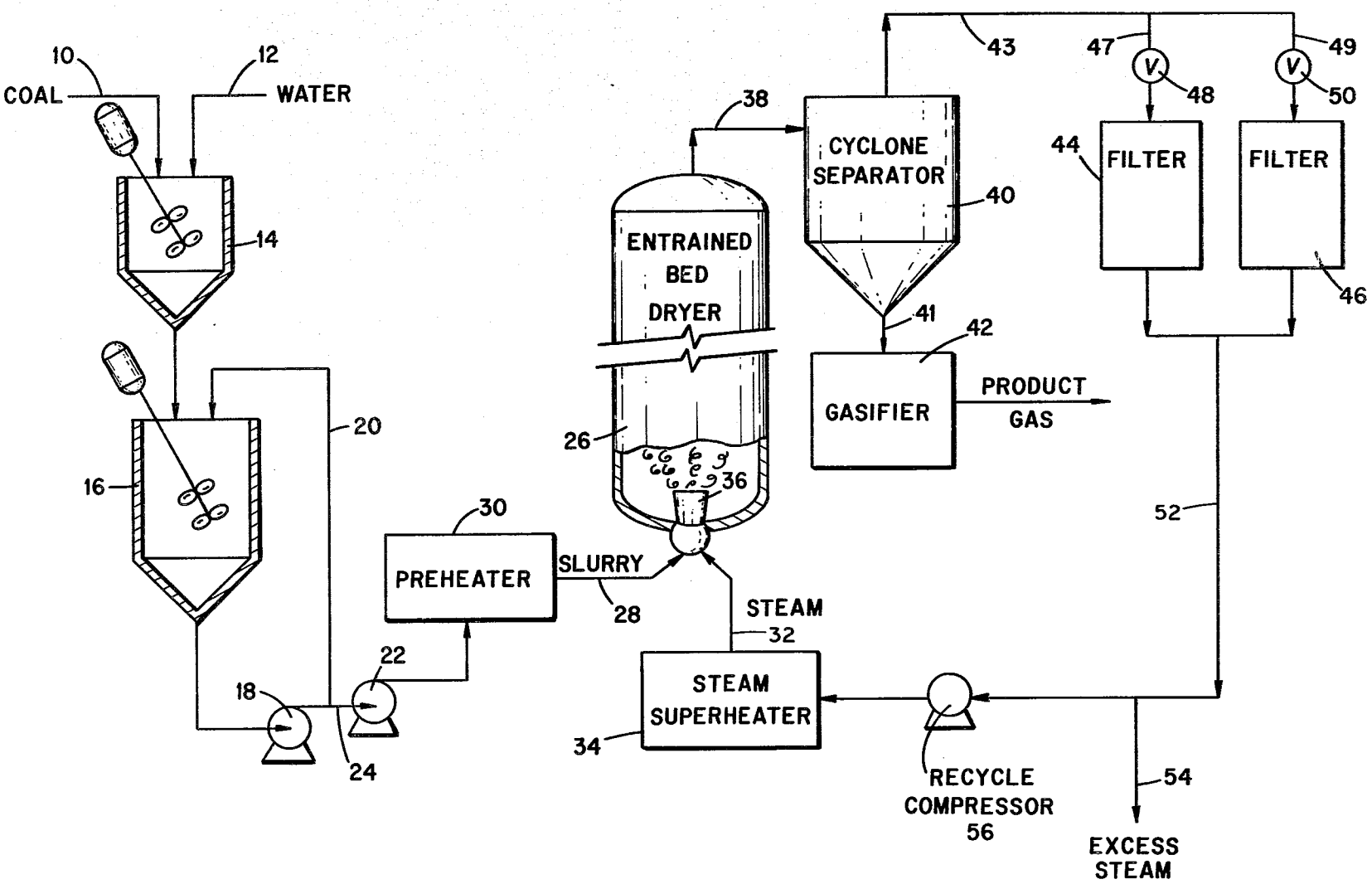
COAL
10
WATER
12
14
16
20
18
22
24
PREHEATER
30
SLURRY
28
26
ENTRAINED BED DRYER
36
STEAM
32
STEAM SUPERHEATER
34
38
CYCLONE SEPARATOR
40
41
GASIFIER
42
PRODUCT GAS
43
FILTER
44
47
48
FILTER
46
49
50
52
RECYCLE COMPRESSOR 56
54
EXCESS STEAM

APPARATUS AND METHOD FOR FEEDING COAL INTO A COAL GASIFIER

The present invention relates generally to the system for introducing coal into a gasifier and, more particularly, to a system for pressurizing the coal to the operating pressure of the gasifier for facilitating the feeding of the coal thereinto.

The conversion of the vast coal reserves of the world to usable fuels is becoming of increasing interest as a possible solution to the ever growing demands for new sources of energy. In this area, coal gasification is of interest as a procedure for the conversion of coal to gas which may be readily used as an energy source, particularly for the production of electrical energy. Of the several known coal gasification processes wherein coal is introduced into a coal gasifier, there have been several problems attendant with the support equipment utilized for introducing the coal into the gasification reactor, particularly since these reactors operate at pressures up to about 1,500 psia.

Lock-hopper systems have been used for introducing the coal into the gasifier. These lock-hopper systems comprise the plurality of valved hoppers disposed between the coal bin and the gasifier with the coal from the bin being loaded into the initial hopper at atmospheric pressure and then the hopper is closed and pressurized through appropriate valves to increase the pressure within the hopper to a pressure corresponding to that of the gasifier. Another valve on the hopper is then opened to discharge the coal into the gasifier. After dicharging the coal, the hopper must then be depressurized before a further load of coal from the bin can be placed in the hopper. The lock-hoppers in addition to requiring an external source of pressurizing gas also suffer some problems with the valves in that the valves within the lock-hopper staging are subjected to considerable erosion from the coal which significantly detracts from the life of the valves.

Attempts to pressurize dry coal in pumps for the introduction of the coal into the pressurized reactor have met with little success since the dry coal is very abrasive and reduces the life of the pump components to an extent where the operation is very uneconomical and inefficient. Efforts to overcome this problem have been partially successful by mixing the coal with water prior to introduction into the pumping system. With the water present, the abrasiveness is reduced to a level where it is economically feasible to utilize a pumping system. However, one of the problems attendant with the pumping of a coal-water slurry to the pressure required for introduction into the gasifier is that excessive water as required for forming the slurry does not provide for an efficient combustion operation. Efforts to remove this water from the coal by employing various liquid-solid separators prior to the introduction of the coal into the gasifier have met with only limited success.

Accordingly, it is the primary goal or aim of the present invention to provide an apparatus and method for feeding dry coal into a pressurized coal gasifier. This goal is achieved by pumping a coal-water slurry to the desired pressure and then removing the water from the slurry prior to the introduction of the coal into the gasifier by contacting the slurry with superheated steam in an entrained bed dryer. The steam is at a temperature sufficient to dry the coal by essentially instantly vaporizing the water in the slurry. At the exit of the entrained bed dryer the steam is relatively easily separated from the coal by employing a simple mechanism such as a cyclone separator. The "dried" coal may then be delivered into a gasifier and the steam recycled through a suitable filtering mechanism back into the entrained bed dryer through a compressor and superheater. The system of the present invention overcomes a considerable problem and is an efficient technique for pressurizing the coal to the level necessary for introduction into the gasifier. Also, the preheating of the coal by the steam and by a preheater upstream of the entrained bed dryer assures a more efficient gasification process in that the coal is nearer the temperature required for the gasification operation which reduces the heat requirements needed during the gasification reaction.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapated to the particular use contemplated.

In the accompanying drawing:

The FIGURE is a schematic representation of the system and system components utilized for the feeding of dry coal to a gasifier in accordance with the techniques of the present invention.

Described generally the present invention is directed to the method and apparatus for feeding coal into a gas producer or coal gasification means operable at a pressure substantially greater than atmospheric pressure. The apparatus utilized for the feeding of the coal comprises mixing chambers wherein a coal-water slurry is formed. This slurry is then pumped to a pressure sufficient for introduction into the gasifier. Superheated steam is generated in a suitable heating means with this steam being at a pressure greater than the entrained bed dryer pressure and fed at a flow rate and temperature sufficient to vaporize essentially all of the water in the slurry upon contact therewith. The slurry and superheated steam are concurrently introduced into an elongated chamber defining the entrained bed dryer at a location adjacent one end of the chamber. A suitable mixing means is disposed within the chamber for receiving the coal-water slurry and the steam and effecting a thorough mixture thereof at the inlet end of the chamber with the steam vaporizing the water from the slurry. The "dried" coal and the steam are passed out of the chamber through an exit adjacent the opposite end of the chamber into a separator where the coal is separated from the steam and then conveyed through a suitable conduit means into the coal gasifier. The steam separated from the coal is passed through a suitable filter arrangement into the compressor and superheater for reuse in the entrained bed dryer for vaporizing the water from the coal slurry. Excess water in the form of steam as provided by the vaporization of the water in the slurry is preferably removed between the steam filters and the compressor.

The slurry and the superheated steam must be mixed immediately and thoroughly at the point of contact within the entrained bed dryer in order to vaporize the water in the slurry without excessively heating the coal, since such excessive heating could result in the agglomeration of the coal particles and in the deleterious deposition of tars and the like within the entrained bed dryer. Further, such heating of the coal within the entrained bed dryer could detract significantly from the gas producing reaction in the gasifier as required for an efficient operation of the gasification mechanism.

Described more specifically and with reference to the accompanying drawing, coal within conduit 10 which is pulverized to a size less than about 0.25 inch and water in line 12 are introduced into a premix chamber 14 to provide a slurry of the coal and water. Preferably sufficient water is admixed with the coal to provide a slurry containing about 30–70 wt.% coal. The premix chamber 14 may be of any suitable conventional design in which the coal and water may be suitably admixed together by a stirring mechanism to form the desired slurry. The slurry from premix chamber 14 is then introduced into a second premix chamber 16 which may be constructed in a manner similar to that of chamber 14 where the slurry is maintained in a continuously agitated state. From the premix chamber 16 the slurry is preferably circulated through a centrifugal pump 18 back into the premix chamber 16 through a bypass conduit 20 to assure that the slurry is maintained in the desired coal-water ratio. The centrifugal pump 18 is also coupled to a high-pressure pump generally shown at 22 through a conduit 24 with this high pressure pump providing a pressurization of the slurry to a pressure which is adequate for introduction into a gasifier operable at a pressure in the range of about 100 to 1500 psia. The high pressure pump is capable of pumping the slurry to the desired pressure without undergoing deleterious or excessive erosion to the pump components normally caused by pumping dry coal. The pressurized coal-water slurry from pump 22 is conveyed via conduit 28 into the entrained bed dryer 26.

The entrained bed dryer 26 as employed in the present invention is an elongated chamber of a sufficient length wherein the drying of the coal by the steam may be achieved. The coal-water slurry introduced into the entrained bed dryer may be preheated to a temperature of about 0° to 100° F. below saturation temperature in a suitable preheater generally shown at 30 so that the slurry will not have an excessive cooling effect upon the steam utilized in the coal drying operation.

The superheated steam utilized for the coal drying operation is introduced into the entrained bed dryer 26 via line 32 at a temperature and flow rate sufficient to vaporize essentially all of the water in the coal upon contact therewith. The necessary superheated steam flow rate to vaporize the water in the coal is dependent upon the steam temperature, the dryer operating pressure, the slurry concentratin, the slurry preheat temperature, and the desired exit temperatures. The steam temperatures found to be sufficient to effect this drying of the coal are in the range of from 100° F. above saturation temperature to 1500° F. The corresponding steam flow rate is in the range of 1 to 15 pounds of steam per pound of slurry for the ranges of dryer operating pressure, slurry concentration, slurry preheat temperature, and desired exit temperature indicated herein.

The steam and slurry are introduced into the entrained bed dryer 26 at a location adjacent to the inlet end thereof so that the steam and slurry can be mixed immediately upon entering the entrained bed dryer. This mixing of the steam and slurry at this location is important in the operation of the invention in that the high temperature steam must not be allowed to excessively heat the coal prior to vaporization of the water therefrom. This vaporization of the water by the steam effectively cools the steam so as to inhibit the excessive heating of the coal. Normally if the coal is maintained at a temperature less than about 700° F. the undesirable tar producing reaction and the agglomeration of coal particles will not occur within the entrained bed dryer.

To effect the desired blending or mixing of the slurry and steam within the inlet end of the entrained bed dryer, a suitable nozzle arrangement, such as generally shown at 36, may be employed. This nozzle is preferably of the type wherein the steam and coal slurry are injected from the nozzle into the chamber along separate but intermingling paths such as provided by a swirling-type nozzles so as to provide the intimate blend of the steam and slurry immediately upon entering the entrained bed dryer 26.

This drying of the coal is affected by the steam which vaporizes the water upon contact therewith and also simultaneously cools down the steam so as to provide a steam and "dry" coal mixture traveling through the length of the dryer 26. This admixture of steam and coal is removed from the dryer via conduit 38 and introduced into a suitable steam-coal separating means, such as for example the cyclone separator generally shown at 40. The dried coal separated from the steam is introduced through conduit 41 into the gasifier 42 for providing the low and high Btu gas in accordance with the well-known gasification techniques.

The steam separated within the cyclone separator is withdrawn via conduit 43 and passed into a suitable filter wherein the small coal particulates trapped within the steam may be removed. The desired filtering of the particles from the steam may be achieved by using well-known filters, such as fabric filters capable of withstanding the high temperatures of the steam within the filtering mechanism. Normally the temperature of the steam leaving the separator 40 is in the range of about 0° to 100° F. above saturation temperature. The fabric filter or similar filtering medium preferably removes approximately 95 to 99.9 percent of the particulate matter above about 1 micron in size. In as much as the gasifier 42 is preferably operated in a continuous manner it may be desirable to place filters in a parallel relationship such as shown at 44 and 46 so as to allow for regeneration or cleaning of one filter while the other is functioning. A pair of conduits 47 and 49 with valves 48 and 50 may be utilized for controlling the flow of steam into the desired filter 44 or 46. The steam once passed through the filters is still at a temperature in the range of about 0° to 100° F. above saturation temperature. Since this steam contains the water separated from the coal-water slurry, the excess steam is preferably removed via line 54 from the conduit 52 prior to introduction of the steam into the recycle compressor 56 and the superheater 34. The quantity of steam removed at line 54 generally corresponds to the quantity of water vaporized from the coal water slurry.

It will be seen that the present invention provides an apparatus and method for feeding dry coal into a gasifier without suffering the drawbacks and shortcomings encountered by employing lock-hopper systems or other dry coal pressurizing mechanisms as set forth above.

What is claimed is:

1. Apparatus for feeding coal into a gasification means operable at a greater than atmospheric pressure comprising mixing means for forming a slurry of coal and water, pumping means coupled to said mixing means for pumping said slurry to a pressure sufficient for introduction into the gasification means, heating means for providing steam at a temperature sufficient to vaporize the water in said slurry and at a pressure greater than the entrained bed dryer pressure, an elongated coal drying chamber, conduit means for separately conveying the slurry and the steam into said chamber adjacent to one end thereof, mixing means within said chamber connected to said conduit means for thoroughly mixing together the slurry and steam immediately upon contact within said chamber to effect vaporization of the water from the slurry without excessively heating the coal to prevent agglomeration of the coal and deposits of tars within said chamber, separating means coupled to said chamber adjacent the opposite end thereof for separating the coal from said steam, and conduit means for conveying the separated coal into the gasification means.

2. The apparatus as claimed in claim 1, wherein further conduit means are coupled to said separating means and said heating means for returning steam separated from the coal into said heating means, wherein filter means are disposed in said conduit means for removing coal particulates from said steam, and wherein steam compressing means are disposed in said conduit means intermediate said filter means and said heating means for boosting steam pressure prior to introduction into said heating means.

3. The apparatus claimed in claim 2, wherein conduit means are coupled to said further conduit means intermediate said filtering means and said compressing means for removing a quantity of steam from said further conduit means with said quantity generally corresponding to the quantity of water vaporized from said coal-water slurry.

4. The apparatus claimed in claim 3, wherein further heating means are disposed in the conduit means conveying the slurry into said chamber for heating the slurry to a temperature of about 0° to 100° F. less than saturation temperature prior to introducing the slurry into the chamber.

5. A method for feeding coal into a gasification means operable at a pressure substantially greater than atmospheric, comprising the steps of forming a slurry of coal and water, pumping the slurry to a pressure corresponding to at least the pressure within the gasification means, introducing the slurry and superheated steam into a coal drying chamber with said steam being at a pressure greater than the pressure within the chamber and at a temperature sufficient to vaporize the water in the slurry, effecting contact between the slurry and steam within the chamber and immediately adjacent the point of entry into the chamber to thoroughly admix the slurry and steam to vaporize essentially all the water in the slurry-steam admixture without excessively heating the coal to prevent agglomeration of the coal and deposits of tars within the chamber, removing the coal and steam mixture from the chamber, separating the coal from the coal-steam mixture, and introducing the coal into the gasification means.

6. The method claimed in claim 5, including the additional steps of recycling steam separated from the coal-steam mixture back into the chamber after compressing said separated steam to said pressure and reheating said separated steam to said temperature, and removing a portion of the separated steam generally corresponding to the volume of water in said slurry prior to the compressing and reheating thereof.

7. The method claimed in claim 6, including the additional step of filtering coal particulates from the separated steam prior to removing said portion.

8. The method claimed in claim 7, including the additional step of heating the slurry to a temperature up to about 0° F. to 100° F. less than saturation temperature prior to the introduction of the slurry into the confined volume.

9. The method claimed in claim 8, wherein the slurry comprises 30 to 70 weight percent coal, and wherein the coal has an average particle size of less than 0.25 inch.

* * * * *